US011650016B2

(12) United States Patent
Swartz et al.

(10) Patent No.: US 11,650,016 B2
(45) Date of Patent: May 16, 2023

(54) METHOD OF INSTALLING A HEAT PIPE WICK INTO A CONTAINER OF DIFFERING THERMAL EXPANSION COEFFICIENT

(71) Applicant: Westinghouse Electric Company LLC, Cranberry Township, PA (US)

(72) Inventors: Matthew M. Swartz, Claridge, PA (US); William A. Byers, Murrysville, PA (US); John Lojek, III, Valencia, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 263 days.

(21) Appl. No.: 16/853,345

(22) Filed: Apr. 20, 2020

(65) Prior Publication Data

US 2021/0325122 A1 Oct. 21, 2021

(51) Int. Cl.
*F28D 15/04* (2006.01)

(52) U.S. Cl.
CPC ..... *F28D 15/046* (2013.01)

(58) Field of Classification Search
CPC .... F28D 15/046; F28D 15/06; F28D 15/0266; F28D 20/028; F28F 2220/00; F28F 2265/26
USPC ..... 165/104.26
See application file for complete search history.

(56) References Cited

U.S. PATENT DOCUMENTS 3,517,730 A * 6/1970 Wyatt ..... F28D 15/06 165/272
4,046,168 A * 9/1977 Milne ..... B65D 59/02 138/89
4,106,188 A * 8/1978 Sekhon ..... H01L 23/427 29/890.032
4,811,759 A * 3/1989 Billoue ..... F16L 55/1116 138/89
4,885,129 A 12/1989 Leonard et al.
5,771,967 A * 6/1998 Hyman ..... B64G 1/50 126/45
7,661,464 B2 * 2/2010 Khrustalev ..... F28D 15/043 165/104.21
2004/0163799 A1 * 8/2004 Connors ..... F28D 15/0283 165/104.26
2009/0285349 A1 11/2009 Ahlfeld et al.
2010/0155033 A1 6/2010 Holley et al.

FOREIGN PATENT DOCUMENTS

EP 3252417 A1 12/2017
JP 57179589 A * 11/1982
WO 2014176069 A2 10/2014

OTHER PUBLICATIONS

International Search Report and Written Opinion for International PCT Application No. PCT/US2021/028137, dated Jul. 26, 2021.

* cited by examiner

*Primary Examiner* — Tho V Duong
(74) *Attorney, Agent, or Firm* — K&L Gates LLP

(57) ABSTRACT

A heat pipe is disclosed includes a container, a container lid including a groove defined therein, a wick, and an end plug operably coupled to the wick. The end plug includes a pin extending therefrom. The groove of the container lid is configured to receive the pin.

22 Claims, 3 Drawing Sheets

METHOD OF INSTALLING A HEAT PIPE WICK INTO A CONTAINER OF DIFFERING THERMAL EXPANSION COEFFICIENT

GOVERNMENT CONTRACT

This invention was made with government support under Contract DE-NE0008853 awarded by the Department of Energy. The government has certain rights in the invention.

BACKGROUND

This invention relates generally to heat pipes used in heat transfer systems, and more particularly, to wicks within the heat pipes that are configured to transfer the working fluid of the heat pipe from a condenser region of the heat pipe to an evaporator region.

A heat pipe is a hermetically sealed, two-phase heat transfer component used to transfer heat from a primary side (evaporator section) to a secondary side (condenser section). FIG. 1, as an example, illustrates a heat pipe 100 comprising the aforementioned evaporator section 102 and condenser section 106, along with an adiabatic section 104 extending therebetween. The heat pipe 100 further includes a working fluid (such as water, liquid potassium, sodium, or alkali metal) and a wick 108. In operation, the working fluid is configured to absorb heat in the evaporator section 102 and vaporize. The saturated vapor, carrying latent heat of vaporization, flows towards the condenser section 106 through the adiabatic section 104. In the condenser section 106, the vapor condenses into a liquid pool 110 and gives off its latent heat. The condensed liquid is then returned to the evaporator section 102 through the wick 108 by capillary action. The aforementioned flow path of the working fluid is illustrated by segmented arrows in FIG. 1. The phase change processes and two-phase flow circulation continues as long as the temperature gradient between the evaporator and condenser sections is maintained. Due to the very high heat transfer coefficients for boiling and condensation, heat pipes are highly effective thermal conductors.

In nuclear systems, heat pipes are utilized by placing the evaporator section of the heat pipe within the reactor core containing nuclear fuel and the condenser section is placed near heat exchangers. The nuclear fuel vaporizes the working fluid and heat exchangers absorb the latent heat at the condenser section. Example heat pipes in nuclear applications are described in U.S. Pat. Nos. 5,684,848, 6,768,781, and U.S. Patent Application Publication No. 2016/0027536, all of which are incorporated by reference in their entirety.

Another example use for heat pipes in nuclear systems is with micro-reactors, which are nuclear reactors that generate less than 10 MWe and are capable of being deployed for remote applications. These micro-reactors can be packaged in relatively small containers, operate without active involvement of personnel, and operate without refueling/replacement for a longer period than conventional nuclear power plants. One such micro-reactor is the eVinci Micro Reactor system, designed by Westinghouse Electric Company. The eVinci system is a heat pipe cooled reactor power system that utilizes heat pipes to act as passive heat removal devices that efficiently move thermal energy out of the reactor core to heat exchangers.

The heat pipes used in the micro-reactors experience extreme operating temperatures (>850° C.) and requires an internal wick that is made from materials that can withstand these temperatures and are compatible with the working fluid. This wick can be constructed from a wire mesh that is rolled and diffusion bonded together into a tube-like structure. The wick tube allows for the working fluid within the heat pipe to pass through it radially (such as after the latent heat is given off and the working fluid is absorbed by the wick) and along its axis (transferring the working fluid back toward the evaporator section with capillary action) while remaining rigid.

In some instances, it is desirable to fabricate the heat pipe container 112 from a different material than the wick 108. As an example, it may be important to maintain good mechanical properties of the container 112, such as ability to withstand high operating pressures of the heat pipe, to mitigate structural concerns. These same mechanical requirements are not imposed on the wick 108. In addition, the outside of the container 112 will be exposed to a different environment that may see a large range of material and chemical interactions. This may necessitate the use of a container 112 material that is not compatible with the working fluid on the inside thereof.

Generally during assembly of the heat pipe 100, a container lid 114 (that is comprised of same material as the container 112) is utilized to seal the wick 108 and working fluid within the container 112 of the heat pipe 100. The container lid 114 includes an end plug 116 extending therefrom that is configured to couple to the wick 108 at an interface 118. It is necessary to maintain a seal at the interface 116 between the end plug 116 of the heat pipe 100 and the evaporator section 102 of the wick 108. Methods of directly coupling the wick 108 and the end plug 116 at the interface 118 includes welding, diffusion bonding and brazing. These methods are not ideally suited to bonding dissimilar metals that are susceptible to different thermal expansion properties (differential thermal coefficients (DTE)). Repeated thermal cycling of materials with DTE will lead to failure over time, which short circuits the heat pipes 100 ability to perform its intended function. In this case, failure is any defect that results in a pore size greater than the pores within the wick 108, which are typically on the order of 10 micrometers. Therefore, utilizing dissimilar wick 108 and container lid/end plug 116 materials runs the risk of failure over time.

It is the goal of the present disclosure to provide a heat pipe that includes a heat pipe container and a wick that are comprised of dissimilar materials and avoid failures mechanisms associated with DTE and dissimilar material compatibility.

SUMMARY

In various embodiments, a heat pipe is disclosed includes a container, a container lid including a groove defined therein, a wick, and an end plug operably coupled to the wick. The end plug includes a pin extending therefrom. The groove of the container lid is configured to receive the pin.

In various embodiments, a wick assembly for use with a heat pipe assembly including a container and a container lid is disclosed. The wick assembly includes a wick and an end plug coupled to the wick. The end plug includes a rod extending therefrom. The rod is configured to be inserted into a recess defined in the container lid.

In various embodiments, a heat pipe is disclosed including a container, a wick, and an end plug coupled to the wick. The container includes a first material and a lid including a recess defined therein. The wick includes a second material. The second material is different that the first material. The end plug includes a shaft extending therefrom. The recess of the lid is configured to receive the shaft.

BRIEF DESCRIPTION OF THE DRAWINGS

Various features of the embodiments described herein, together with advantages thereof, may be understood in accordance with the following description taken in conjunction with the accompanying drawings as follows.

Corresponding reference characters indicate corresponding parts throughout the several views. The exemplifications set out herein illustrate various embodiments of the invention, in one form, and such exemplifications are not to be construed as limiting the scope of the invention in any manner.

DETAILED DESCRIPTION

Numerous specific details are set forth to provide a thorough understanding of the overall structure, function, manufacture, and use of the embodiments as described in the specification and illustrated in the accompanying drawings. Well-known operations, components, and elements have not been described in detail so as not to obscure the embodiments described in the specification. The reader will understand that the embodiments described and illustrated herein are non-limiting examples, and thus it can be appreciated that the specific structural and functional details disclosed herein may be representative and illustrative. Variations and changes thereto may be made without departing from the scope of the claims.

Figure 2:
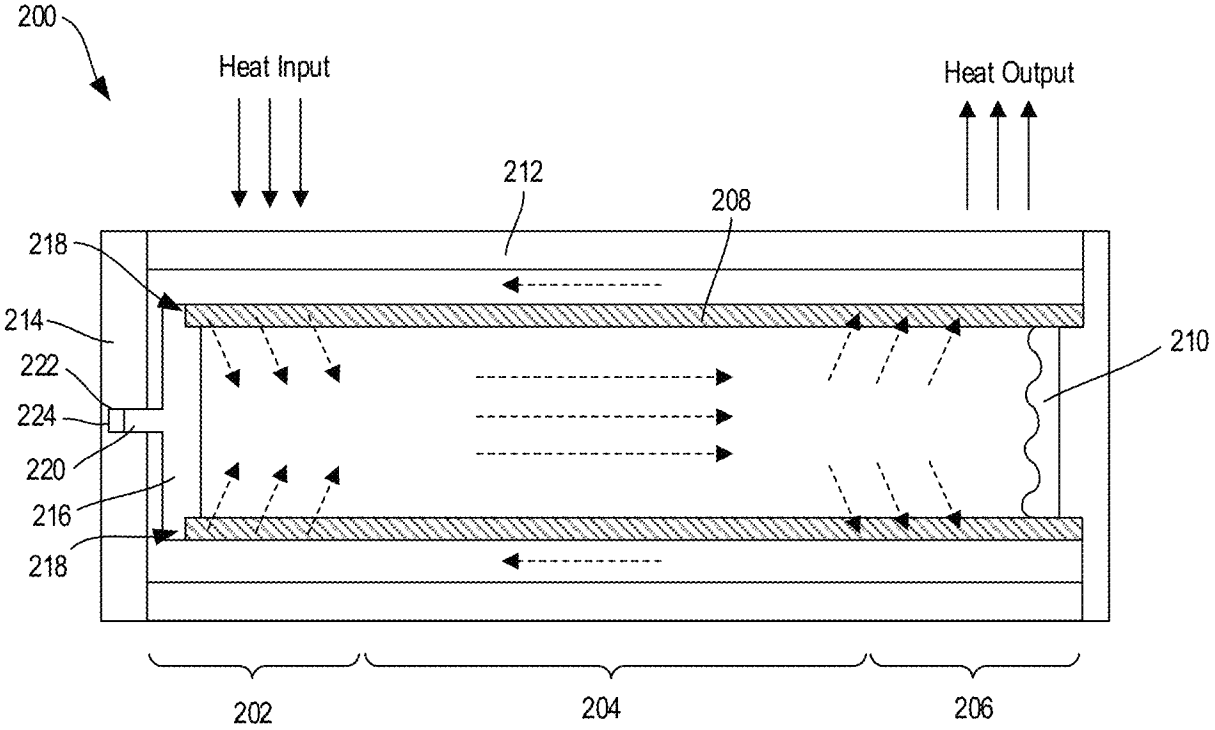
FIG. 2 illustrates a heat pipe having a container lid and an end plug, according to one aspect of the present disclosure.

FIG. 2 illustrates a heat pipe 200 accordingly at least one aspect of the present disclosure. The heat pipe 200 includes an evaporator section 202, a condenser section 206, and an adiabatic section 204 extending therebetween. The heat pipe 200 further includes a working fluid (such as water, liquid potassium, sodium, or alkali metal) and a wick 208 positioned within a container 212. In operation, the working fluid is configured to absorb heat in the evaporator section 202 and vaporize. The saturated vapor, carrying latent heat of vaporization, flows towards the condenser section 206 through the adiabatic section 204. In the condenser section 206, the vapor condenses into a liquid pool 210 and gives off its latent heat. The condensed liquid is then returned to the evaporator section 202 through the wick 208 by capillary action. The aforementioned flow path of the working fluid is illustrated by segmented arrows in FIG. 2. The phase change processes and two-phase flow circulation continues as long as the temperature gradient between the evaporator and condenser sections is maintained.

The wick 208 material is selected such that the wick 208 is compatible with the working fluid of the heat pipe 200 (such as alkali metal), as well as is able to withstand the high operating temperatures of the heat pipe 200 (>850° C.). In operation, the wick 200 can expand and contract based on the thermal expansion properties of the wick 208. As an example, a wick 208 fabricated from 300 series stainless steel has high thermal expansion properties, leading to large fluctuations in size during operation of the heat pipe 200.

The heat pipe 200 further includes an end plug 216 that can interface and couple to the wick 208 at an interface 218. The wick 208 can be coupled to the end plug 216 by any suitable coupling method, such as with welding, diffusion bonding, brazing, fasteners, adhesive, or any suitable form of coupling. The end plug 216 further includes a centering pin 220 extending therefrom.

The end plug 216 can be constructed with the same, or at least substantially the same, material as the wick 208 such that the thermal expansion properties of the wick 208 and the end plug 216 are the same, or at least substantially the same. The end plug 216 being fabricated from the same, or at least substantially the same, material as the wick 208 avoids failure mechanisms associated with DTE and dissimilar material compatibility between the wick 208 and the end plug 216. In other embodiments, the wick 208 and end plug 216 can comprise dissimilar materials that include similar, or at least substantially similar thermal expansion coefficients such that the wick 208 and end plug 216 expand and contract at similar rates, while also mitigating failures associated with DTE.

Figure 1:
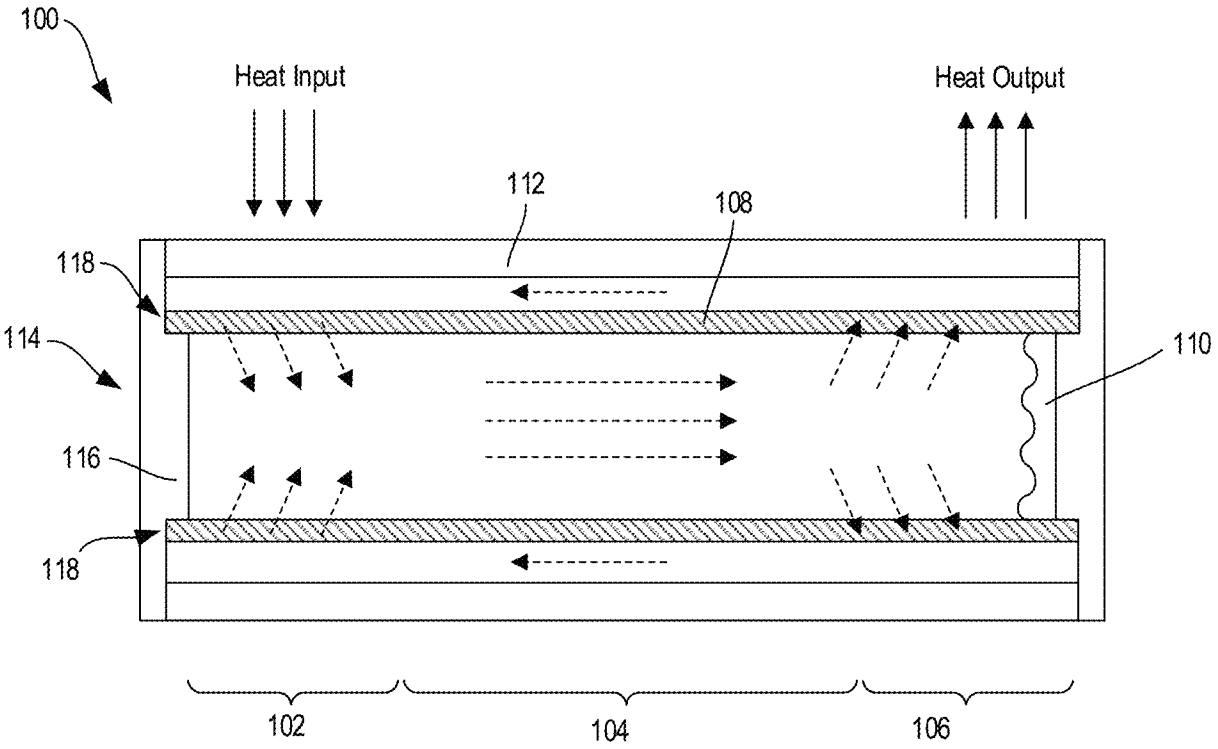
FIG. 1 illustrates a heat pipe having a container lid with an end plug extending therefrom.

The heat pipe 200 further including a container lid 214. Unlike the heat pipe 100 illustrated in FIG. 1, the container lid 214 and the end plug 216 are separate and distinct components. The container lid 214 includes a groove or recess 222 defined therein that can receive the pin 220 extending from the end plug 216, thereby coupling the end plug 216 to the container lid 214. The pin 220 and the groove 222 are configured to center the wick 208 within the container 212, which is important for the thermal performance of the heat pipe 200. In addition, the groove 222 comprises a length that is the same, or at least substantially the same, as the length of the pin 220. Other embodiments are envisioned where the length of the groove 222 and the length of the pin 220 are different.

In operation, as the wick 208 expands and contracts due to fluctuating operating temperatures experienced by the heat pipe 200, the pin 220 can slide within the groove 222, accommodating the axial movement of the wick 208 and end plug 216. The groove 222 can include a sufficient length such that the pin 220 abuts the end 224 of the groove 222 at the same, or at least substantially the same, time as the end plug 216 contacts the container lid 214. In another embodiment, the groove 222 can include a length such that the pin 220 abuts the end 224 of the grove 222 prior to the end plug 216 contacting the container lid 214. In another embodiment, the end plug 216 can contact the container lid 214 prior to the pin 220 abutting the end 224 of the groove 222. The use of the pin 220/groove 222 allows the container 212 and the container lid 214 to be constructed or manufactured from materials dissimilar to the wick 208 and the end plug 216. By isolating the sealing interface 218 as a separate part that can move with respect to the container 212 and container lid 214, failure mechanisms associated with DTE in a bonded plug/heat pipe design are eliminated. Existing methods of forming annular heat pipe wicks, as described with respect to FIG. 1, require the wick to be bonded to the container/end plug.

The pin 220 and the groove 222 can include any suitable cross-sectional shape such that the pin 220 can axially slide through the groove 222 based on growth and shrinkage of the wick 208. In one embodiment, the pin 220 and the groove 222 can include circular cross-sectional shapes. The use of circular cross-sectional shapes allows the pin 220 to be slidable within the groove 222, but allows the end plug 216 to be rotatable relative to the container lid 214. In other embodiments, the pin 220 and the groove 222 can include a square cross-sectional shape. The use of a square cross-sectional shape allows the pin 220 to be slidable within the groove 222, while also preventing the end plug 216 from rotating relative to the container lid 214. Other suitable cross-sectional shapes are envisioned, such as oval, star, pentagon, or octagon cross-sectional shapes, as examples. The small diameter or cross-sectional shape of the pin 220 allows for tight part tolerances even considering a large DTE between the wick 208 material and container lid 214 material or container 212 material.

The above-described invention applies to heat pipe materials with larger or smaller thermal expansion coefficients compared to the wick. The container groove 222 is be designed to accept growth or shrinking of the wick 208 length (relative to the heat pipe container 212) by properly sizing the groove 220 dimension and also properly setting the initial position of the pin 220.

Figure 3:
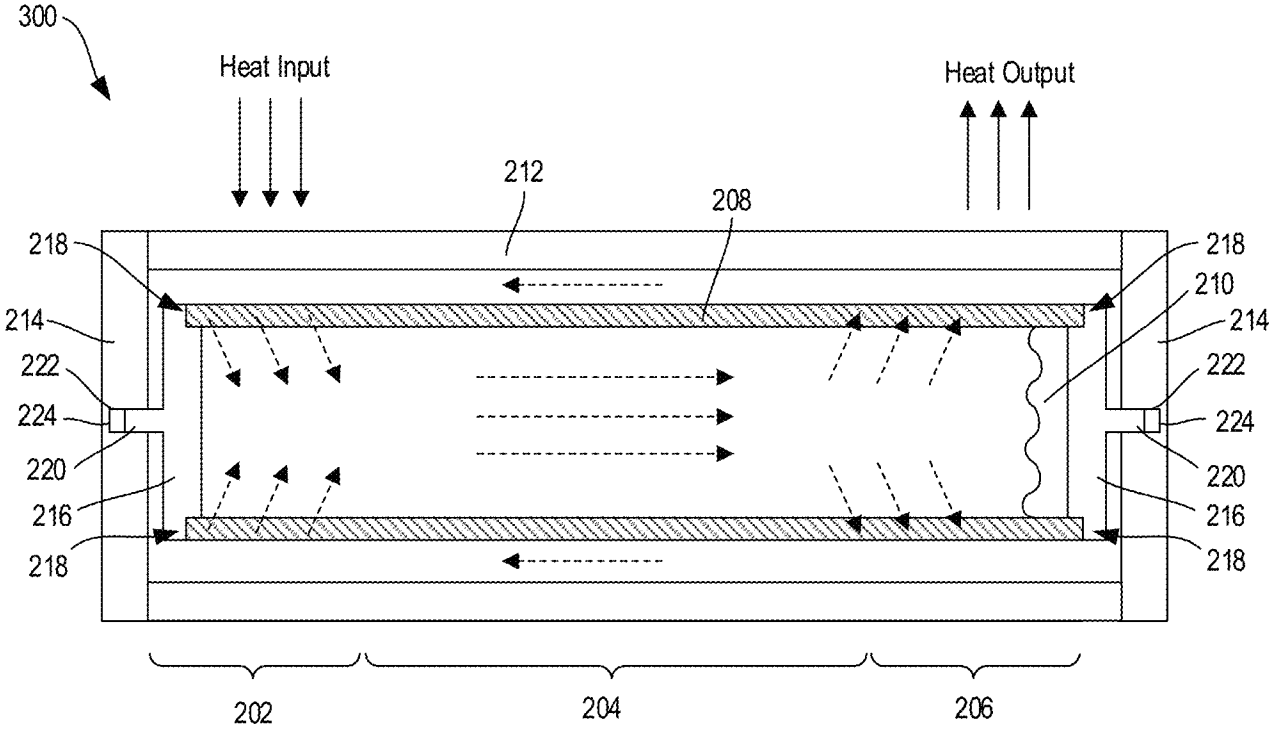
FIG. 3 illustrates a heat pipe having two container lids and end plugs, according to one aspect of the present disclosure.

While FIG. 2 illustrates a heat pipe 200 with one container lid 214/groove 222/end plug 216/pin 220, other heat pipes are envisioned wherein the heat pipe, such as heat pipe 300 illustrated in FIG. 3, includes a container lid 214/groove 222/end plug 216/pin 220 on both ends of the heat pipe. The use of more than one container lid 214/groove 222/end plug 216/pin 220 allows the wick to thermally expand in more than one direction.

Various aspects of the subject matter described herein are set out in the following examples.

Example 1—A heat pipe comprising a container, a container lid comprising a groove defined therein, a wick, and an end plug operably coupled to the wick. The end plug comprises a pin extending therefrom. The groove of the container lid is configured to receive the pin.

Example 2—The heat pipe of Example 1, wherein the wick comprises a first material. The end plug comprises a second material. The first material is substantially identical to the second material.

Example 3—The heat pipe of Example 1, wherein the wick comprises a first material. The container comprises a second material. The first material and the second material are different.

Example 4—The heat pipe of Example 3, wherein the end plug comprises the first material.

Example 5—The heat pipe of any one of Examples 1-4, wherein the pin comprises a first cross-sectional shape. The groove comprises a second cross-sectional shape. The first cross-sectional shape and the second cross-sectional shape are substantially identical.

Example 6—The heat pipe of any one of Examples 1-5, wherein the pin is configured to center the wick within the container.

Example 7—The heat pipe of any one of Examples 1-6, wherein the pin is slidable within the groove based on growth and shrinkage of the wick.

Example 8—A wick assembly for use with a heat pipe assembly comprising a container and a container lid. The wick assembly comprises a wick and an end plug coupled to the wick. The end plug comprises a rod extending therefrom. The rod is configured to be inserted into a recess defined in the container lid.

Example 9—The wick assembly of Example 8, wherein the wick comprises a first material. The end plug comprises a second material. The first material is substantially identical to the second material.

Example 10—The wick assembly of Example 8, wherein the wick comprises a first material. The container comprises a second material. The first material and the second material are different.

Example 11—The wick assembly of Example 10, wherein the end plug comprises the first material.

Example 12—The wick assembly of any one of Examples 8-11, wherein the rod comprises a first cross-sectional shape. The recess comprises a second cross-sectional shape. The first cross-sectional shape and the second cross-sectional shape are substantially identical.

Example 13—The wick assembly of any one of Examples 8-12, wherein the rod is configured to center the wick within the container.

Example 14—The wick assembly of any one of Examples 8-13, wherein the rod is slidable within the recess based on growth and shrinkage of the wick.

Example 15—A heat pipe comprising a container, a wick, and an end plug coupled to the wick. The container comprises a first material and a lid comprising a recess defined therein. The wick comprising a second material. The second material is different that the first material. The end plug comprises a shaft extending therefrom. The recess of the container lid is configured to receive the shaft.

Example 16—The heat pipe of Example 15, wherein the end plug comprises a third material substantially identical to the second material.

Example 17—The heat pipe of Examples 15 or 16, wherein the shaft comprises a first cross-sectional shape. The recess comprises a second cross-sectional shape. The first cross-sectional shape and the second cross-sectional shape are substantially identical.

Example 18—The heat pipe of any one of Examples 15-17, wherein the shaft is configured to center the wick within the container.

Example 19—The heat pipe of any one of Examples 15-18, wherein the shaft is slidable within the groove based on growth and shrinkage of the wick.

Unless specifically stated otherwise as apparent from the foregoing disclosure, it is appreciated that, throughout the foregoing disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

One or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features.

The term "substantially", "about", or "approximately" as used in the present disclosure, unless otherwise specified, means an acceptable error for a particular value as determined by one of ordinary skill in the art, which depends in part on how the value is measured or determined. In certain embodiments, the term "substantially", "about", or "approximately" means within 1, 2, 3, or 4 standard deviations. In certain embodiments, the term "substantially", "about", or "approximately" means within 50%, 20%, 15%, 10%, 9%, 8%, 7%, 6%, 5%, 4%, 3%, 2%, 1%, 0.5%, or 0.05% of a given value or range.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. A heat pipe, comprising:

a container;

a container lid comprising a groove defined therein;

a wick; and an end plug operably coupled to the wick, wherein the end plug comprises a pin extending therefrom, wherein the groove of the container lid is configured to receive the pin, and wherein the pin is slidable within the groove based on growth and shrinkage of the wick.

2. The heat pipe of claim 1, wherein the wick comprises a first material, and wherein the end plug comprises a second material.

3. The heat pipe of claim 1, wherein the wick comprises a first material, wherein the container comprises a second material, wherein the first material and the second material are different.

4. The heat pipe of claim 3, wherein the end plug comprises the first material.

5. The heat pipe of claim 1, wherein the pin comprises a first cross-sectional shape, and wherein the groove comprises a second cross-sectional shape.

6. The heat pipe of claim 1, wherein the pin is configured to center the wick within the container.

7. The heat pipe of claim 2, wherein the first material is identical to the second material.

8. The heat pipe of claim 5, wherein the first cross-sectional shape and the second cross-sectional shape are identical.

9. A wick assembly for use with a heat pipe assembly comprising a container and a container lid, wherein the wick assembly comprises:

a wick; and an end plug coupled to the wick, wherein the end plug comprises a rod extending therefrom, wherein the rod is configured to be inserted into a recess defined in the container lid, and wherein the rod is slidable within the recess based on growth and shrinkage of the wick.

10. The wick assembly of claim 9, wherein the wick comprises a first material, and wherein the end plug comprises a second material.

11. The wick assembly of claim 9, wherein the wick comprises a first material, wherein the container comprises a second material, wherein the first material and the second material are different.

12. The wick assembly of claim 11, wherein the end plug comprises the first material.

13. The wick assembly of claim 9, wherein the rod comprises a first cross-sectional shape, and wherein the recess comprises a second cross-sectional shape.

14. The wick assembly of claim 9, wherein the rod is configured to center the wick within the container.

15. The wick assembly of claim 10, wherein the first material is identical to the second material.

16. The wick assembly of claim 13, wherein the first cross-sectional shape and the second cross-sectional shape are identical.

17. A heat pipe, comprising:

a container, comprising:

a first material; and a lid comprising a recess defined therein;

a wick comprising a second material, wherein the second material is different that the first material; and an end plug coupled to the wick, wherein the end plug comprises a shaft extending therefrom, wherein the recess of the lid is designed and dimensioned to receive the shaft, and wherein the shaft is slidable within the recess based on growth and shrinkage of the wick.

18. The heat pipe of claim 17, wherein the end plug comprises a third material.

19. The heat pipe of claim 17, wherein the shaft comprises a first cross-sectional shape, and wherein the recess comprises a second cross-sectional shape.

20. The heat pipe of claim 17, wherein the shaft is configured to center the wick within the container.

21. The heat pipe of claim 18, wherein the third material is identical to the second material.

22. The heat pipe of claim 19, wherein the first cross-sectional shape and the second cross-sectional shape are identical.

* * * * *